US006013043A

United States Patent [19]

Forner

[11] Patent Number: 6,013,043

[45] Date of Patent: Jan. 11, 2000

[54] DEVICE FOR MONOPODIC REEDUCATION

[76] Inventor: Flavio Forner, Via Cav. E. Dartora 10—31030, Pederobba Fraz. Covolo (Prov. of Treviso), Italy

[21] Appl. No.: 08/671,116

[22] Filed: Jun. 25, 1996

[30] Foreign Application Priority Data

Jul. 4, 1995 [IT] Italy ..... TV95A0082

[51] Int. Cl.[7] ..... A61F 5/00

[52] U.S. Cl. ..... 602/23

[58] Field of Search ..... 602/5, 16, 23, 602/27, 28, 29, 65, 66, 10, 9; 128/882; 36/115, 132, 14, 15, 36 A, 140, 150, 155, 167

[56] References Cited

U.S. PATENT DOCUMENTS

| | | | |
|---|---|---|---|
| 3,024,021 | 3/1962 | Coplin et al. . | |
| 3,924,615 | 12/1975 | McKim | 602/26 |
| 4,304,417 | 12/1981 | Hsieh | 280/11.26 |
| 5,372,576 | 12/1994 | Hicks | 602/27 |
| 5,569,174 | 10/1996 | Varn | 602/27 |
| 5,593,383 | 1/1997 | DeToro | 602/66 X |

FOREIGN PATENT DOCUMENTS

| | | |
|---|---|---|
| 896 338 | 7/1983 | Belgium . |
| 85 16 328 | 8/1985 | Germany . |
| 88 13 866 | 2/1989 | Germany . |
| 43 04 331 | 9/1993 | Germany . |
| 8 502 659 | 4/1987 | Netherlands . |
| 980 145 | 1/1965 | United Kingdom . |

*Primary Examiner*—Jerome W. Donnelly
*Assistant Examiner*—Kim M. Lee
*Attorney, Agent, or Firm*—Guido Modiano; Albert Josif; Daniel J. O'Byrne

[57] ABSTRACT

A device for monopodic reeducation having a support for a user foot and elastically deformable elements that can be selectively associated with the support in a downward region. The device is particularly effective for curing various disorders of the pelvic limbs, of the spinal column, for the prevention of injuries that may occur during sports activities in which monopodic standing is required, and for recovering the functions of the antigravity postural muscles.

9 Claims, 1 Drawing Sheet

DEVICE FOR MONOPODIC REEDUCATION

BACKGROUND OF THE INVENTION

The present invention relates to a device for monopodic reeducation, particularly for the treatment of various disorders of the pelvic limbs, of the spinal column, for the prevention of injuries that may occur during sports activities in which standing on a single foot is required and for the recovery of the functions of the postural antigravity muscles, particularly in the elder people.

In order to maintain the erect antigravity posture there are specific muscles, termed postural muscles, which are controlled by the cerebellum; since these muscles are involuntary, their automatic operation is controlled by an interplay of receptor information that is located in the foot sole and interacts with the neurological system of vestibular equilibrium.

During monopodic standing, a neurological component, the so-called "archicerebellum", belonging to the subcortical vestibular equilibrium system is influenced by the receptors that are present in the muscles of the deep anterior plantar layer, which are constituted by the adductor of the hallux, by the transverse and oblique bundles, and by the short flexor of the hallux.

During walking, the adductor and the short flexor of the hallux maintain pelvic equilibrium, coordinating the activity of the tripod, i.e., of the pes anserinus muscles.

During walking, said deep anterior plantar layer acts in the monopodic support phase, and the archicerebellum maintains equilibrium during this phase.

During running there is no bipedic phase; there are periods in which the right foot, and then the left foot, rests on the ground separated by flight periods.

In this case, the information sent by the deep anterior plantar layer becomes shorter as monopodic leaning decreases, and said monopodic leaning decreases as the running speed increases.

This period of anterior monopodic leaning highlights the importance of the archicerebellar equilibrium system, which is closely linked to the running speed.

The faster the running speed, the more the individual crouches; the elbows are folded and close to the body, which is tilted forwards, so that the center of gravity is located as forward as possible.

The particular position of the nape of the neck and of the eyes is conditioned by the vestibule-eye-nape circuit under archicerebellar control, with tight dependency on the pressure receptors that are packed in the adductor and flexor muscles of the hallux.

In order to reeducate the muscles of the deep plantar layer and to maintain pelvic equilibrium during monopodic support, an implement is currently used which is constituted by an open shoe below which a wood hemisphere is connected by screwing.

This hemisphere usually has three different screwing points; this is done both to provide a different application point, and therefore a different stimulation of the user's foot, and to allow to use the same open shoe by adapting it to users having different foot sizes.

This conventional implement, however, has drawbacks due to the particular static behavior of the open shoe: the hardness of the foot resting surface causes the muscles of the deep anterior plantar layer to continue to send constant information to the archicerebellum, which is capable of memorizing the signals received, invalidating the therapeutic functionality of the implement.

The memorization ability of receptors is a very important element in motor rehabilitation: persistence of the same stimulus allows the archicerebellum to store said stimulus, adapting the reaction to the new but permanent situation, and no improvement in rehabilitation is thus obtained.

Furthermore, the specific arrangement of the hemisphere with respect to the open shoe limits the possibility of adapting the implement to the specific requirement of the individual for complete and optimum rehabilitation.

Another drawback is linked to the limited performance of the individual implement with respect to foot sizes; it is in fact necessary to provide for individual open shoes for each size or to try and combine a plurality of sizes for the same open shoe.

SUMMARY OF THE INVENTION

A principal aim of the present invention is to eliminate the drawbacks described above in conventional implements by providing a device that allows to achieve gradual reeducation of equilibrium during monopodic support in an optimum manner with regard to the type of disorder, subjecting the muscles of the deep anterior plantar layer to different stimuli without allowing memorization of said stimuli in the archicerebellum.

Within the scope of this aim, an important object is to provide a device that can be adapted in an optimum manner to different users, allowing to adjust the hardness of the implement and micrometric adjustment of its movement according to the specific individual work to which the user is subjected.

Another important object is to provide a device that can be used easily and quickly by any individual, regardless of his age group, allowing even individuals of higher age groups to perform reeducation correctly.

Another important object is to provide a device that allows to rehabilitate the muscle chains that are adapted for antigravity somatic posture, i.e., the chain of foot flexors and extensors.

Another important object is to provide a device that is structurally simple and easy to industrialize and has low manufacturing costs.

Another object is to provide a device that associates with the preceding characteristics that of being reliable and safe in use.

this aim, these objects, and others that will become apparent hereinafter are achieved by a device for monopodic reeducation, characterized in that it comprises a support for a shoe and elastically deformable means that can be selectively associated with said support in a downward region.

BRIEF DESCRIPTION OF THE DRAWINGS

Further characteristics and advantage of the invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
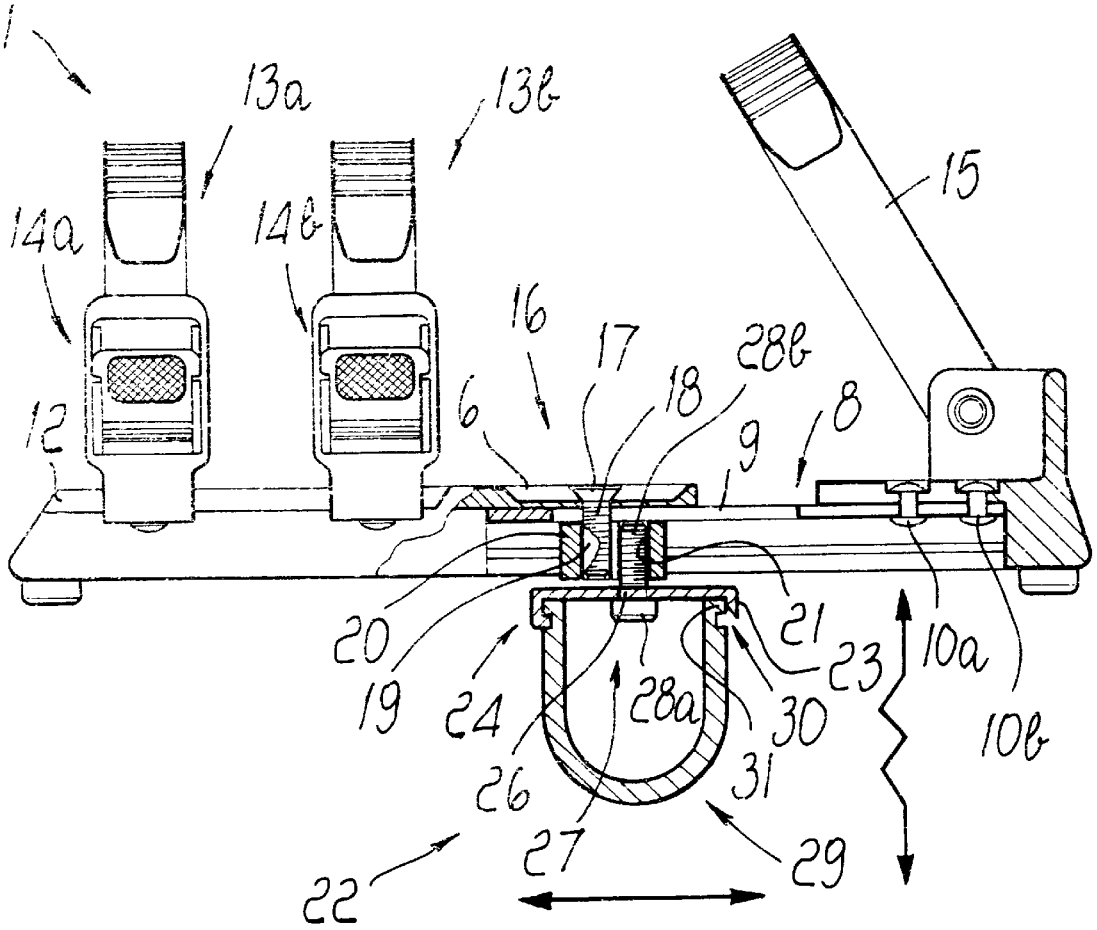
FIG. 1 is a partially sectional side view of the reeducation device.
Figure 2:
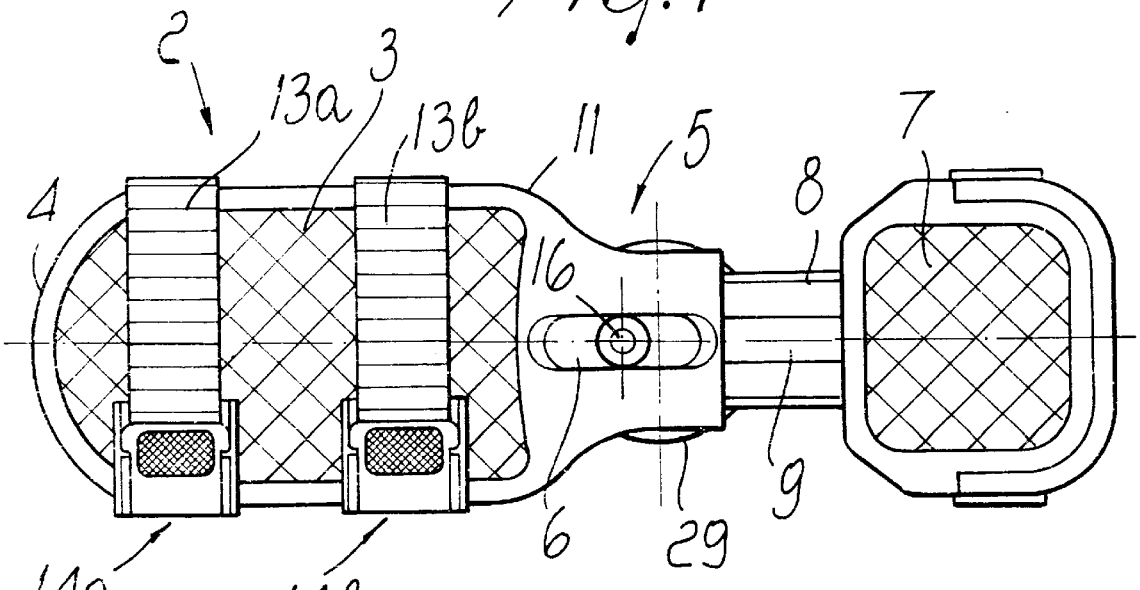
FIG. 2 is a top view of the device of FIG. 1.

With reference to the above figures, the advice for monopodic reeducation, generally designated by the reference numeral 1, comprises a shoe support constituted by an extendable plate 2 that is substantially flat and has such a length as to allow support of the front part of the user's foot.

Said plate 2 is constituted by a first element 3 having a substantially rectangular plan shape with a curved front side 4.

A tab 5 protrudes axially with respect to the first element 3 at the other end with respect to the front side 4; said tab 5 has a first slot 6 formed along a median axis that lies longitudinally to said plate 2.

A second substantially rectangular element 7 is slidingly and selectively associated with the first element 3 and lies below the heel of the foot.

The second element 7 has a rail 8 that is associated centrally below it.

Said rail 8, which protrudes towards the tab 5, has a second slot 9 formed along a median axis that lies longitudinally to the second element 7, said rail being associated with the second element 7 by means of appropriate pins, designated by the reference numerals 10*a* and 10*b*.

The first element 3 has a flap 12 protruding along the entire perimetric edge 11 and adapted to allow the coupling of two straps 13*a* and 13*b* arranged transversely thereto.

Each one of said two straps 13*a* and 13*b* interacts with a first engagement means 14*a* and 14*b* that is adapted to secure the user's foot for rigid and fixed connection of said foot to the first element 3.

Likewise, a third strap 15 is pivoted to the second element 7 and allows to secure the user's foot instep.

The rail 8 is slideable below the first element 3 and can be secured thereto in a vise-like fashion by means of a screw 16 that interacts with a notch 20.

Said screw 16 has a first head 17 that can be accommodated at the first slot 6; a first stem 18 protrudes axially from the first head 17, passes through said second slot 9, and can be inserted in a complementarily shaped first seat 19 formed axially in the notch 20.

Said notch 20 has a second seat 21 formed along an axis that is parallel to the axis of the first seat 19 and arranged proximate thereto.

Elastically deformable means, generally designated by the reference numeral 22, are detachably associable below the notch 20 and are constituted by a base 23 that is preferably circular and is perimetrically provided with an L-shaped annular ridge 24 protruding away from the rail 8.

A hole 26 is formed centrally to said base 23 and is adapted to allow the passage of a second threaded screw 27 having a second head 28*a* form which a second stem 28*b* protrudes axially; said second stem 28*b* can be inserted in the complementarily shaped second seat 21 formed in the notch 20.

A third elastically deformable element 29 is detachably associable with the ridge 24 of the base 23 in a downward region, is preferably hemispherical, and is provided with a complementarily shaped seat formed at the perimetric edge for snap-action connection to the annular ridge 24.

Said seat is constituted by an external perimetric recess 30 adapted to form a flap 31 that can be inserted with a snap action in the annular ridge 24 of the base 23.

Operation is as follows: the rail 8 is made to slide on the tab 5, tightening the first screw 16 according to the length of the user's foot; the base 23 is associated with the notch 20, inserting the second screw 27 in the complementarily shaped second seat 21; then the third element 29 is associated with a snap action, inserting the flap 31 in the ridge 24 of the base 23.

The work performed by the user by using the third elastically deformable element 29 produces no articular damage of microtraumas, allowing to recover the functions of the antigravity postural muscles, and can thus be used by an individual of any age group.

The possibility of varying the elasticity of the third element 29 allows to adapt the device to the particular and specific rehabilitation plan of the user, depending on the disorder and on the recovery work that has been set at the medical level.

It has been observed that the device thus conceived has achieved the intended aim and objects and is ideal for achieving gradual reeducation of equilibrium during monopodic support: by subjecting the muscles of the deep anterior plantar layer to different stimuli, since the foot is rested on an elastic surface, the signals sent to the archicerebellum are changed continuously, without allowing said archicerebellum to memorize them.

The device can furthermore be easily adapted to any length of the user's foot, since the first and second elements are slideable with respect to each other; moreover, the fact of being able to perform micrometric movements at the connection of the third elastically deformable element allows to adapt the device to the specific individual work to which the user must be subjected.

Of course, said device can be used easily by any individual, regardless of his age, allowing even higher age-group individuals to perform reeducation correctly.

Said particular device has furthermore turned out to be useful for the effective stimulation of the orthostatic muscle chains that start at the foot.

It is in fact known that there are two complementary and alternative muscle chains for antigravity somatic posture: the foot flexor and extensor chains.

The extensor chain is stimulated during walking, by placing the third elastically deformable element as backward as possible, towards the heel, so as to recover the somatic forward droop caused by the position of said third element.

Also during walking, by placing the third elastically deformable element as forward as possible, towards the tip of the foot, it is possible to lift the heel, stimulating the flexor chain of the foot.

The invention is of course susceptible of numerous modifications and variations, all of which are within the scope of the same inventive concept.

The elastically deformable means can be constituted by one or more springs arranged coaxially to the second stem 28*b* and interposed between the plate 20 and the base 23.

As an alternative, the elastically deformable means can be constituted by one or more springs.

Thus, for example, the elastically deformable means can be constituted by a sphere or hemisphere or other internally hollow or full solid that is associable with the notch 20.

The materials and the dimensions constituting the individual components of the device may of course also be the most appropriate according to the specific requirements.

What is claimed is:

1. A device for monopodic reeducation, comprising: a support for a user's foot; and elastically deformable means being selectively associable below said support, said foot support being constituted by an extendable plate, said plate being substantially flat and having a width allowing resting of a front part of the user's foot, said plate comprising: a first element, said first element having a substantially rectangular plan shape with a curved front side; and a tab protruding on an opposite side and axially with respect to said first element, said tab having a first slot, said first slot being formed along a median axis that lies longitudinally to said plate, the device further comprising a second element lying below a heel portion of the foot and being substantially rectangular, said second element being slidingly and selectively associable with said first element, and said second element further comprising a rail, said rail being associated centrally below said second element, said rail protruding towards said tab, a second slot being provided on said rail, said second slot being formed along a median axis that lies longitudinally to said second element, and said device comprising pins, said pins being insertable in said second slot for connection thereof to said second element, said first element having a flap, said flap protruding along an entire perimetric edge thereof, at least one pair of straps being coupled to said flap, said straps being arranged transversely to said plate, each one of said straps interacting with a first engagement means for allowing securing of the user's foot, the device further comprising a notch and a screw interacting therewith, said rail being slideable below said first element and being respectively securable thereto in a vise-like fashion through said screw and notch, said screw comprising a first head, said first head being accommodatable at said first slot, a first stem protruding axially from said first head, said stem passing through said second slot, and being insertable in a complementarily shaped first seat, said first seat being formed in said notch, said notch comprising a second seat, said second seat being formed along an axis that is parallel to an axis of said first seat, said second seat being arranged proximate to said first seat, said elastically deformable means being removably associable below said notch, and said elastically deformable means comprising a preferably circular base, said base being perimetrically provided with an L-shaped annular ridge, said ridge protruding on an opposite side with respect to said rail, and an elastically deformable element being associable with said ridge.

2. Device according to claim 1, wherein a hole is provided centrally with respect to said base, said hole allowing passage of a second threaded screw, said second screw having a second head, a second stem protruding axially from said second head, said second stem being insertable in said second seat, said second seat being shaped complementarily and being formed in said notch.

3. Device according to claim 2, wherein said elastically deformable element is preferably hemispherical and is removably associable with said ridge of said base in a downward region thereof, said elastically deformable element having a complementarily shaped seat formed at the perimetric edge for snap-action connection to said annular ridge.

4. Device according to claim 3, wherein said complementarily shaped seat of said third element is constituted by an external perimetric recess, said recess forming a flap, said flap being insertable between said ridge and said base.

5. Device according to claim 1, wherein said elastically deformable means is constituted by any of a sphere, a hemisphere and other internally hollow and full solid associable with said notch.

6. Device according to claim 1, wherein said elastically deformable element is constituted by any of one and several springs.

7. Device according to claim 1, wherein said elastically deformable element is constituted by at least one spring, said at least one spring being interposed between said plate and said base.

8. A device for monopodic reeducation, comprising: a support for a user's foot; and elastically deformable means being selectively associable below said support, said foot support comprising a first element for resting of a front part of the user's foot, said first plate having a first slot, said first slot being formed along a median axis that lies longitudinally to said first element, said foot support further comprising a second element for resting of a heel portion of the user's foot, said second element being slidingly and selectively associable with said first element, and said second element having a second slot formed along a median axis that lies longitudinally to said second element, the device further comprising a notch and a screw interacting therewith, said second element being slideable with respect to said first element and being respectively securable thereto in a vise-like fashion through said screw and notch, said screw passing through said second slot and being insertable in a complementarily shaped first seat, said first seat being formed in said notch, said notch comprising a second seat, said second seat being formed along an axis that is parallel to an axis of said first seat, said second seat being arranged proximate to said first seat, said elastically deformable means being removably associable below said notch, and said elastically deformable means comprising a base being perimetrically provided with an L-shaped annular ridge, an elastically deformable element being associable with said ridge.

9. A device for monopodic reeducation, comprising:

a support for a user's foot, said support having a longitudinal extension extending between a front toe portion of the support and a rear heel portion of said support;

an elastically deformable element connected below said support and having a substantially concave support profile; and a connection device for adjustably connecting said elastically deformable element below said support such that said elastically deformable element is adjustably connected in a selected position along the longitudinal extension of said support;

said front toe portion said rear heel portion of said support being mutually slideable with respect to one another in a direction of said longitudinal extension, said front toe portion and rear heel portion of said support being adjustably connected with one another by means of said connection device such as to select an adjustable length of said support along said longitudinal extension.

* * * * *